US005109233A

United States Patent [19]

Nishikawa

[11] Patent Number: 5,109,233

[45] Date of Patent: Apr. 28, 1992

[54] METHOD OF DISCHARGING LIQUID DURING A DISCHARGE STABILIZING PROCESS AND AN INK JET RECORDING HEAD AND APPARATUS USING SAME

[75] Inventor: Hiroshi Nishikawa, Tokyo, Japan

[73] Assignee: Canon Kabushiki Kaisha, Tokyo, Japan

[21] Appl. No.: 604,994

[22] Filed: Oct. 29, 1990

Related U.S. Application Data

[63] Continuation of Ser. No. 361,555, Jun. 5, 1989, abandoned.

[30] Foreign Application Priority Data

Jun. 8. 1988 [JP] Japan ..... 63-139364
Jun. 2. 1989 [JP] Japan ..... 63-139315

[51] Int. Cl.[5] ..... B41J 2/05; B41J 2/165
[52] U.S. Cl. ..... 346/1.1; 346/140 R
[58] Field of Search ..... 346/1.1, 140, 75

[56] References Cited

U.S. PATENT DOCUMENTS 3,747,120 7/1973 Stemme .
3,803,628 4/1974 Van Brimer ..... 346/75 X
3,925,788 12/1975 Kashio ..... 346/75
3,925,789 12/1975 Kashio ..... 346/75
4,001,839 1/1977 Krause ..... 346/75
4,176,363 11/1979 Kasahara ..... 346/140 R
4,177,471 12/1979 Mitchell ..... 346/140
4,489,335 12/1984 Watanabe ..... 346/140
4,558,332 12/1985 Takahashi ..... 346/140 R
4,590,482 5/1986 Hay ..... 346/140 X
4,712,172 12/1987 Kiyohara et al. ..... 346/1.1
4,723,129 2/1988 Endo et al. ..... 346/1.1
4,791,435 12/1988 Smith ..... 346/140

FOREIGN PATENT DOCUMENTS 133338 10/1979 Japan .
104338 6/1985 Japan .

*Primary Examiner*—Joseph W. Hartary
*Attorney, Agent, or Firm*—Fitzpatrick, Cella, Harper & Scinto

[57] ABSTRACT

A method of driving an ink jet recording head and discharging ink during a preliminary discharge process comprises discharging liquid from less than all of a plurality of discharge units during a discharge stabilizing process. In a specific embodiment, during the discharge stabilizing process liquid is discharged from discharge units selected from a plurality of discharge units prior to recording to rid the liquid passages associated with the discharge units of ink which has increased in viscosity.

36 Claims, 8 Drawing Sheets

KB
KEYBOARD
DSP
DISPLAY UNIT
ATC
AUTO-CLEAR CIRCUIT
PSC
POWER SUPPLY CIRCUIT
1 LSI
2
CPU
3
RAM
AR
BR
4
ROM
M4
M3
M2
M1
S2
S3
S4
S5
S6
S7
S8
S9
S10
S11
S1
DR1
HEAD DRIVE CIRCUIT
HEAD DRIVE CIRCUIT
DR2
R1
R2
TR2
TR1
S12
DR3
MOTOR DRIVE CIRCUIT
CN2
M
+V2
CN1
H1
H2
H3
H4
H5
H6
H7
H8
H9
H10
H11
H12
HT
+V1

METHOD OF DISCHARGING LIQUID DURING A DISCHARGE STABILIZING PROCESS AND AN INK JET RECORDING HEAD AND APPARATUS USING SAME

This application is a continuation of application Ser. No. 07/361,555 filed Jun. 5, 1989, now abandoned.

BACKGROUND OF THE INVENTION

1. Field of the Invention

The present invention relates to a method of driving an ink jet recording head and a recording apparatus which employs the driving method and, more particularly, to an ink jet recording head which can reduce a period of time necessary for a discharge stabilizing process, such as recovery of ink discharge and preliminary discharge of ink, and can reliably execute that process, a method of driving the ink jet recording head, as well as a recording apparatus which employs the recording method.

2. Related Background Art

One ink jet recording technique involves supplying ink from an ink tank into liquid passages of an ink jet recording head, and subjecting the ink in the liquid passages to mechanical energy produced by electromechanical transducers such as piezoelectric elements, or thermal energy produced by electro-thermal transducers such as a pyrogenic elements (see U.S. Pat. No. 3,747,120, U.S. Pat. No. 4,723,129, etc.). Ink is thus discharged from discharge openings in communication with the liquid passages so that an image in the form of characters or graphics is formed on a recording member (e.g., recording paper).

The inner diameter of the liquid passages and the diameter of the discharge openings are often very small, in the order of about 50 μm, for example. Therefore, if the period in which no ink is discharged (i.e., recording stop period) is prolonged, the position of an ink meniscus may be moved back from the discharge opening into the liquid passage, or the viscosity of ink remaining in the ink jet recording head may be increased due to drying attendant on evaporation of ink. In such a condition, no ink will be discharged from the discharge opening or unstable discharge will occur even when sufficient mechanical or thermal energy is applied to the ink. The occurrence of such non-discharge or unstable discharge condition makes it difficult to obtain good image recording.

In order to solve the above problem, it has been proposed to count the time of the recording stop period and eject ink from a nozzle (discharge opening) when the counted period exceeds a predetermined time, or preliminarily eject ink from the nozzle upon a printing command being applied after the recording stop period has lasted beyond a predetermined time, as disclosed in U.S. Pat. No. 3,925,788 and U.S. Pat. No. 3,925,789 by way of example.

Alternatively, U.S. Pat. No. 4,712,172 discloses a technique to apply electrical energy to an electro-thermal transducer to an extent that ink will not be discharged, and then carry out preliminary ink discharge.

While such preliminary discharge operation can always permit good recording of an image such as characters or graphics, an attempt at prolonging a period of the preliminary discharge operation or shortening intervals between the preliminary discharge operations is made to assure more stable image recording for a longer term.

However, there may occur some disadvantages if the preliminary discharge operation is carried out for a sufficiently long period or with short intervals.

For example, the preliminary discharge period is usually set to about 1–1.2 sec. However, periods of time in this order often give users a waiting time that they may find awkward, particularly for equipment such as electronic calculators and typewriters which are required to make records on recording paper quickly in response to keys being depressed on a keyboard, or those devices which are designed to perform high-speed continuous recording.

Further, the preliminary discharge for a sufficiently long period or with short intervals results in a large amount of ink being accumulated in an ink collector for collecting ink of preliminary discharge. In case of the collector formed of an absorber, there may occur a risk of ink which has been absorbed in the absorber overflowing and staining the interior of the unit or flowing out to the exterior.

Another problem is that the use of large amounts of ink for the preliminary discharge wastes a large amount of ink, which prevents the efficient utilization of ink, particularly in a system of the on-demand type.

SUMMARY OF THE INVENTION

With a view of overcoming the above-mentioned problems in the prior art, it is an object of the present invention to provide an ink jet recording apparatus which can shorten a period of the preliminary discharge and reduce an amount of ink necessary for the preliminary discharge.

Another object of the present invention is to provide a method of driving an ink jet recording head provided with a plurality of discharge units each having a discharge opening to discharge a liquid and a discharge energy generator associated with the discharge opening, wherein a discharge energy generator selected from the plurality of discharge units is driven only during a discharge stabilizing process of the ink jet recording head.

Still another object of the present invention is to provide an ink jet recording apparatus comprising a driver for producing drive signals supplied to discharge energy generators of an ink jet recording head provided with a plurality of discharge units each having a discharge opening to discharge a liquid and the discharge energy generator associated with the discharge opening and, a circuit for producing a preliminary discharge signal to drive at least one of the discharge units prior to recording.

A yet further object of the present invention is to provide an ink jet recording head comprising a first discharge unit having a discharge opening to discharge a liquid for recording and a discharge energy generator associated with the discharge opening, and a second discharge unit dedicated to preliminary discharge, and having a discharge opening to discharge only a liquid having no relation to recording and a discharge energy generator associated with the discharge opening.

DETAILED DESCRIPTION OF THE EMBODIMENTS

Hereinafter, the present invention will be described in detail with reference to the drawings.

Figure 1:
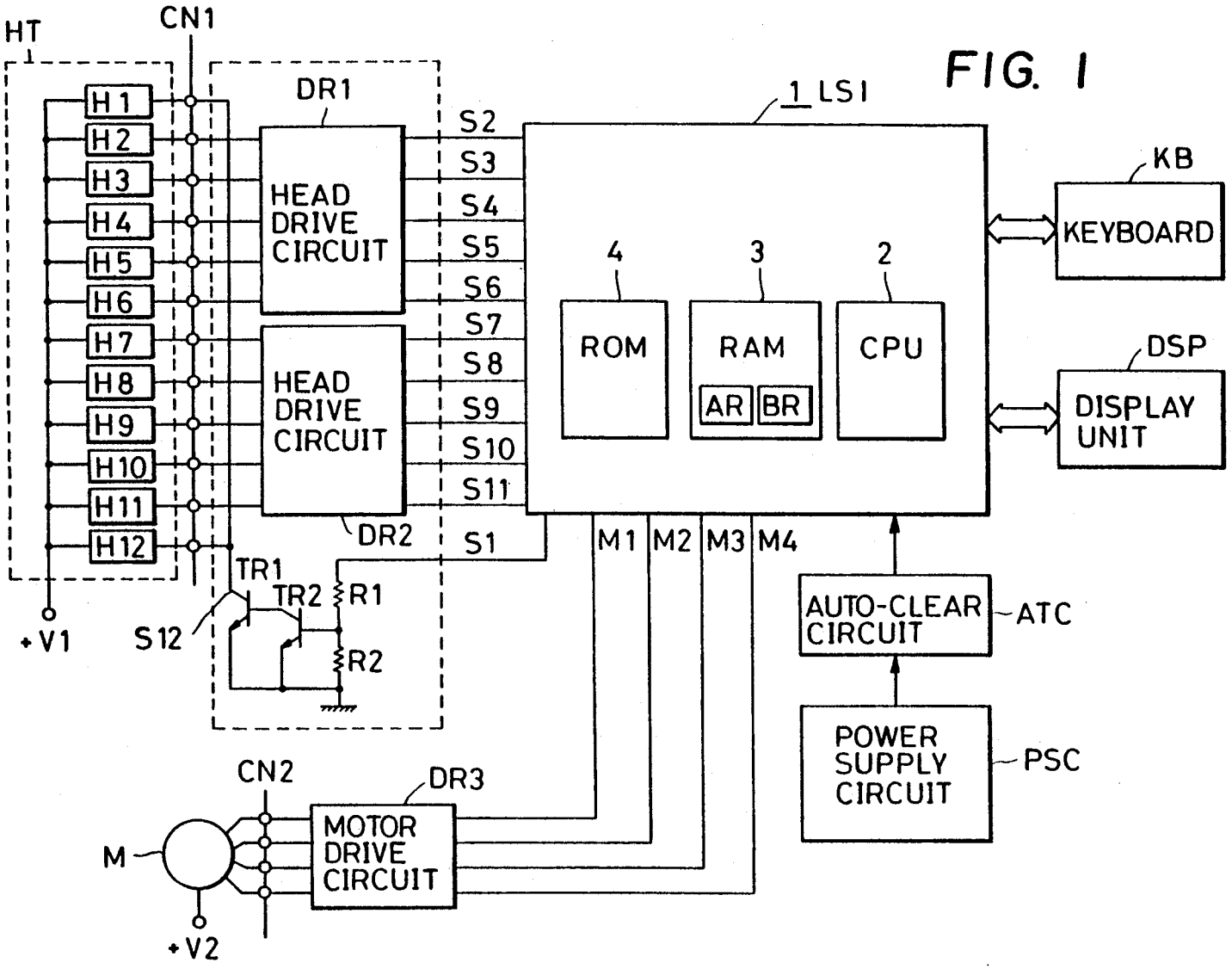
FIG. 1 is a block diagram for explaining the principal configuration of an electronic calculator according to one preferred embodiment of the present invention.

FIG. 1 is a block diagram for explaining the principal configuration of an electronic calculator which incorporates, as a printer, an ink jet recording apparatus according to one preferred embodiment of the present invention. In FIG. 1, denoted by PSC is a power supply circuit for supplying electric power to a large scale integrated circuit, an ink jet recording unit and other components, described later. KB is a keyboard which includes numerical keys for inputting numerical values and function keys for commanding arithmetic operations such as addition and subtraction.

When a user depresses any one of the numerical keys and the function keys, the large scale integrated circuit (LSI) 1 executes entry of a numerical value, or arithmetic operation such as addition or subtraction based on a command corresponding to the key depressed, and then outputs the executed result to a display unit and the ink jet recording unit, both described later. The LSI1 consists of three main components below.

More specifically, denoted by 2 is a central processing unit (CPU) which executes a certain processing procedure in response to the key being depressed on the keyboard KB. Denoted by 4 is a read only memory (ROM) which executes overall processing for the electronic calculator, such as a processing procedure described later in connection with the flowchart of FIG. 5. Denoted by 3 is a random access memory (RAM) which serves as a work area for temporarily storing the recording/display data or intermediate progress of the arithmetic operations by way of example, during the processing executed by the CPU2. Also, the RAM3 includes registers AR, BR involved in the preliminary discharge process. It will be understood that the LSI1 is not limited to the single integrated circuit as shown in FIG. 1, and it may be of an assembly comprising a plurality of integrated circuits.

Denoted by DSP is a display unit which indicates the entered numerical values or the computed results on display means such as a CRT, fluorescent tube or liquid crystal display, for example. ATC is an auto-clear circuit which issues an auto-clear signal for initializing the LSI1, when a power switch is turned from an off-state to an on-state for energizing the power supply circuit PSC.

Denoted by DR1 and DR2 are head drivers which output drive signals in response to recording signals from recording signal output terminals S2–S11 of the LSI1. Thus, the drivers DR1 and DR2 pass currents to heaters of the ink jet recording unit, described later, after current amplification of the recording signals. TR1 and TR2 are transistors and R1 and R2 are resistors. These transistors and resistors jointly constitute a so-called Darlington circuit. This circuit (preliminary discharge circuit) is turned on when a signal from an output terminal S1 specific to preliminary discharge takes a high level, the terminal S1 being so controlled by the LSI1 to take a high-level signal only during a preliminary discharge period. Upon turning-on of the preliminary discharge circuit, a current is supplied to later-described heaters H1 and H12 which are in the form of electro-thermal transducers.

Denoted by HT is a heater group. Heat generated by heaters H1–Hx (x=12 in the figure) of the heater group produces air bubbles, thereby causing ink to be discharged from respective ink discharge openings of the ink jet recording head. More specifically, each discharge unit has a heater in the form of an electro-thermal transducer for rapidly heating ink. When an electric pulse is applied to the heater, the resultant rapid heat generation from the heater produces an air bubble in the liquid passage of the discharge unit. Ink is then discharged from the ink discharge opening in response to expansion and contraction of the air bubble.

As will be seen from the figure, the heater group HT consists of 12 heaters, and 12 ink discharge openings are disposed corresponding to the heaters in one-to-one relation. Among them, 10 heaters H2–H11 are supplied with drive signals corresponding to the contents of recording commands, i.e., recording signals S2–S11 from the LSI1, so that ink is discharged from the ink discharge openings to record characters, graphics or the like on a recording member. The heaters H1 and H12 are dedicated to preliminary discharge, and the ink discharge openings associated with these heaters are disposed at opposite ends of an array of the discharge openings associated with the heaters H2–H11, respectively. Preliminary discharge is carried out using the 10 heaters H2–H11 and the 2 heaters H1, H12, or only the 2 heaters H1, H12.

Denoted by DR3 is a motor driver which supplies signals from motor drive output terminals M1–M4 of the LSI1 to a later-described stepping motor of the ink jet recording unit after current amplification thereof. M is a stepping motor rotatable in response to the signals M1–M4 from the LSI1 for moving a carriage such that the recording head is located exactly facing a position on recording paper at which an image is to be recorded. CN1 and CN2 are connectors for connecting between the printer section and the control section.

Figure 2:
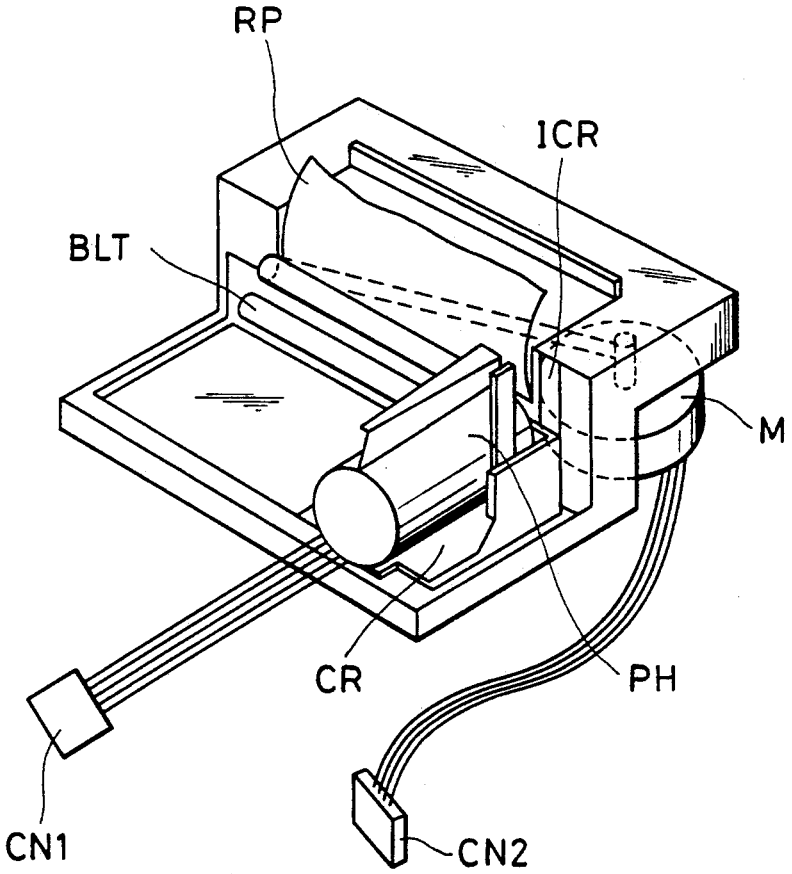
FIG. 2 is a schematic perspective view showing a printer section in the electronic calculator having the principal configuration shown in FIG. 1.

FIG. 2 is a prespective view showing the printer section in the electronic calculator shown in FIG. 1. In FIG. 2, denoted by RP is recording paper that records thereon the intermediate progress and final results of calculations performed by the electronic calculator. As the stepping motor M rotates, a pulley mounted on a spindle of the stepping motor M is turned and a belt BLT entrained between a pair of pulleys disposed at opposite ends of a recording area in the printer section is run, thereby moving a carriage CR attached to a portion of the belt BLT in a horizontal direction so that a recording (printing) head PH mounted on the carriage CR can take its recording position. The recording head PH mounted on the carriage CR includes the heater group HT, the ink discharge openings, etc. explained above in connection with FIG. 1. Note that an ink tank is built in the recording head PH in this embodiment. ICR is an ink collector provided outside the recording area for the purpose of preliminary discharge. The ink collector is preferably disposed adjacent to the recording area as illustrated. Also, the ink collector is preferably formed of an ink absorber or the like from the standpoint of disposal of waste ink.

Figure 3:
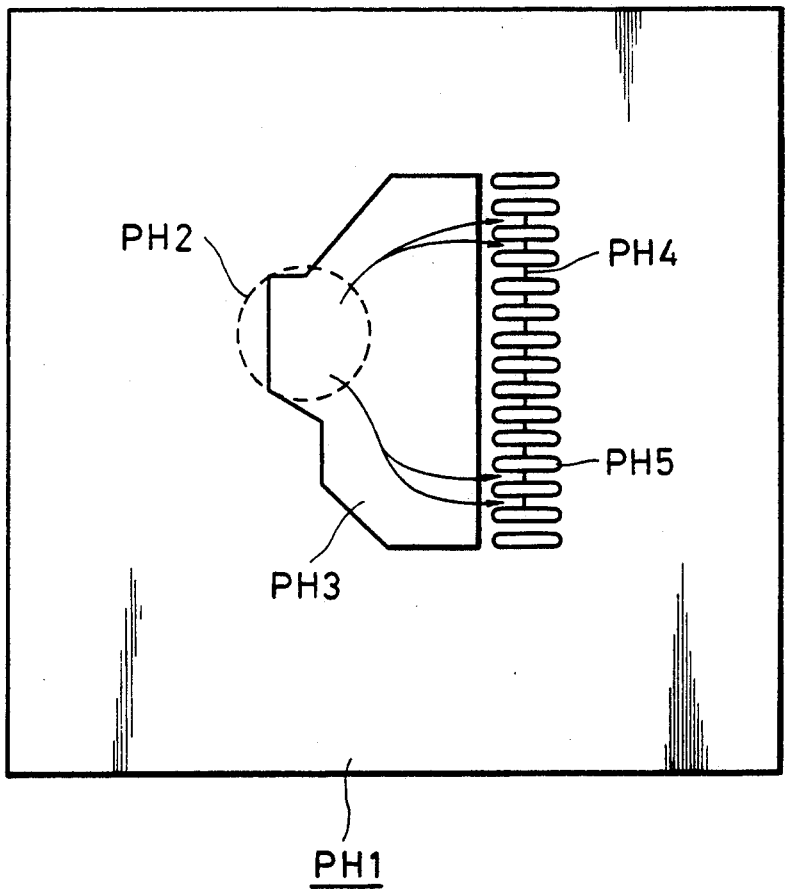
FIG. 3 is a schematic front view of a discharge plate in the recording head shown in FIG. 2.

FIG. 3 is a front view of a discharge plate PH1 in the recording head PH shown in FIG. 2. In FIG. 3, denoted by PH2 is an ink supply hole for allowing ink to be fed into the discharge plate PH1 therethrough from a supply tube in communication with an ink tank (not shown). PH3 is a manifold for temporarily storing ink supplied through the ink supply hole PH2. Ink is supplied from the manifold PH3 to 12 discharge units. PH4 designates a discharge opening corresponding to each of the 12 discharge units, and PH5 designates a wall to partition adjacent discharge openings PH4. Among the 12 discharge openings PH4, those two positioned at opposite ends of the array of discharge openings are dedicated to carry out preliminary discharge in cooperation with the aforementioned heaters H1, H12, and have no relation to recording.

Figure 4:
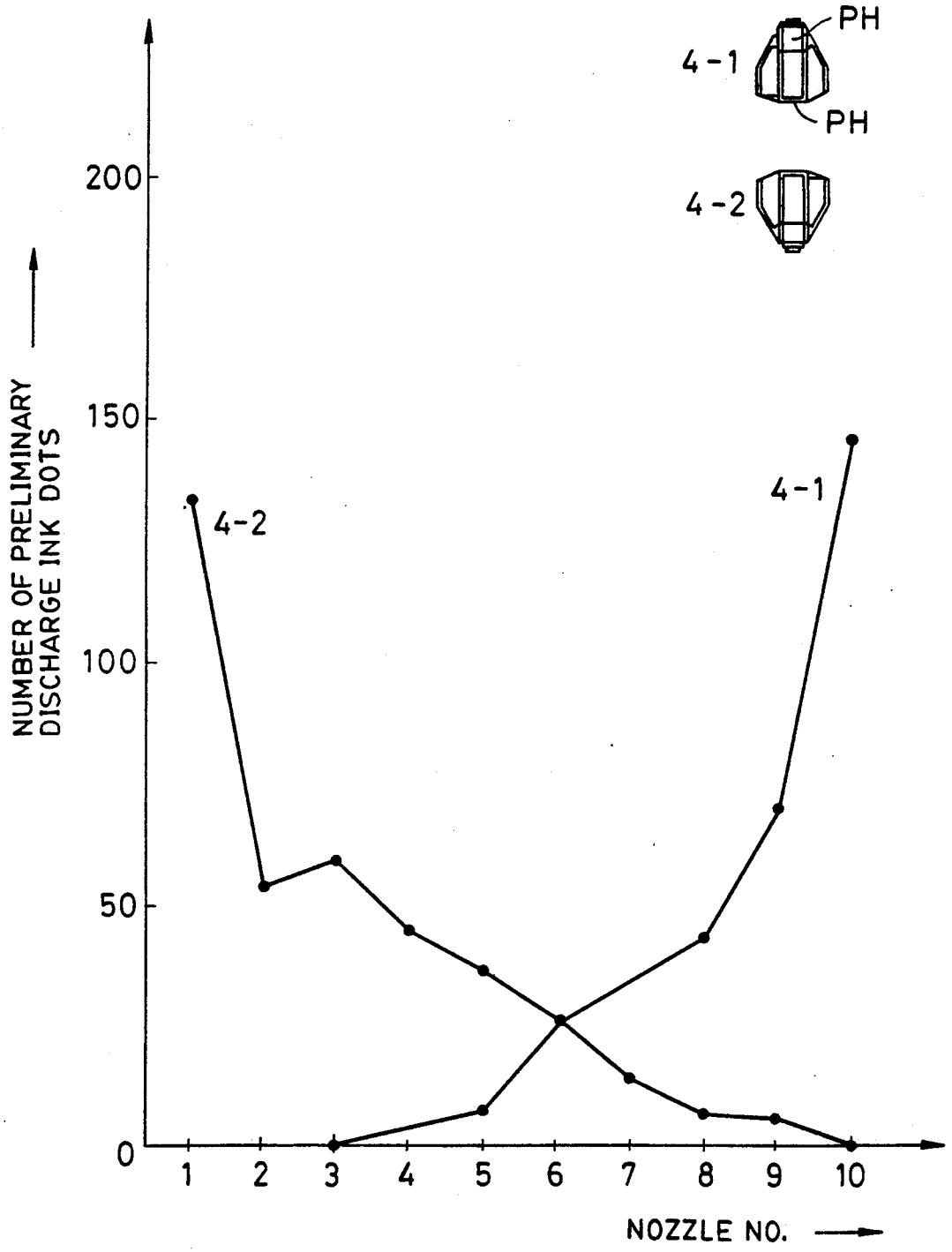
FIG. 4 is a graph for explaining the present invention.

FIG. 4 is a graph for explaining the present invention, in which there is plotted, for each discharge opening, the number of preliminary discharge dots necessary for recovery of a good discharge condition from the state where no ink has been discharged for a predetermined time. Plotted lines 4-1 and 4-2 correspond to respective orientations of the recording head PH shown at the upper right corner in FIG. 4. In the respective orientations of the recording head, the discharge opening No. 10 relating to the line 4-1 and the discharge opening No. 1 relating to the line 4-2 are positioned at the lowest level.

As will be apparent from FIG. 4, the discharge unit disposed at the extreme end of the array of discharge openings is susceptible to non-discharge of ink and hence requires the large number of preliminary discharge dots because of the increased viscosity due to tendency of ink flow, temperature distribution in the recording head, and other factors. In view of the above, the present invention is intended to reduce the number of preliminary discharge dots necessary for the discharge units employed in recording to reach a good discharge condition, as a whole, by arranging the discharge units taking no part in recording at the extreme ends of the array of discharge openings.

Figure 5:
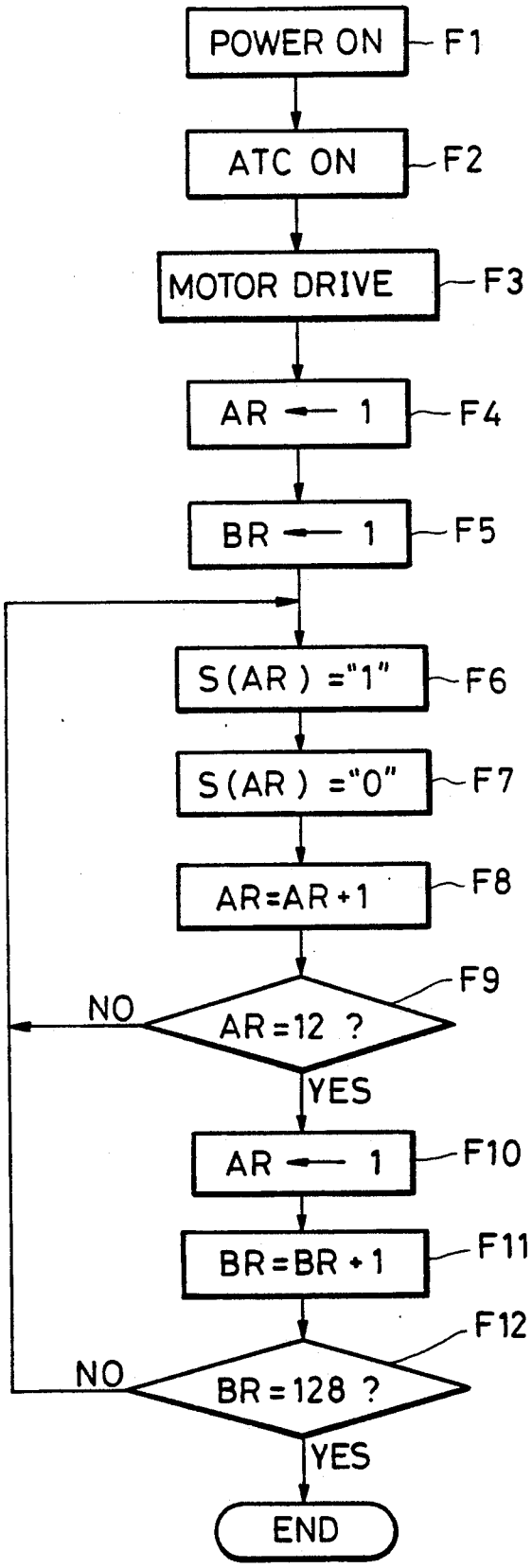
FIG. 5 is a flowchart showing one example of a processing procedure for preliminary discharge in the electronic calculator having the principal configuration shown in FIG. 1.

FIG. 5 is a flowchart showing one example of a processing procedure implemented for the printer section of the electronic calculator shown in FIGS. 1 to 3. In FIG. 5, when the power switch of the electronic calculator is turned on in a step F1, the auto-clear circuit ATC is operated to inform the LSI1 of changeover of the power switch from "OFF" to "ON" in a step F2. This allows the LSI1 to execute the initialization required upon turning-on of the power.

The preliminary discharge process represented by steps F3–F12 and involved in the initialization as its part will be described below. More specifically, the step F3 outputs the motor drive signals M1–M4 sequentially to drive the stepping motor M after current amplification of those signals by the motor driver DR3. This causes the carriage CR mounting thereon the recording head PH to be moved to a position facing the ink collector ICR. Next, the step F4 writes data 1 in the register AR, and the step F5 writes data 1 in the register BR. As a result , both the registers AR and BR are initialized.

In the step F6, one of the signals (terminals) S1–S11 that is specified by the register AR is set to logic "1". In this case, the signal S1 is set to logic "1". In the next step F7, one of the signals (terminals) S1–S11 that is specified by the register AR is set to logic "0". In this case, the signal S1 is set to logic "0". With these two steps, a recording step is output to one of the signal terminals S1–S11. In the step F8, the content of the register AR is counted up to sequentially change the signal terminal from which a pulse is output. The next step F9 ascertains whether or not the content of the register AR has reached 12 beyond a range of the signal terminals S1–S11 for recording.

If the content of the register AR is not equal to 12, the above steps F6–F9 are repeated to sequentially output pulses to the remaining one(s) of the signal terminals S1–S11. If the content of the register AR is equal to 12, the control process goes to the step F10 where data 1 is written into the register AR. This causes the register AR to start specifying one of the signal terminals for recording from S1 once again. Next, the step F11 counts up the content of the register BR, and the step F12 ascertains whether or not the content of the register BR is equal to 128. These steps are intended to control the number of times of the processing steps F6–F9 to be repeated for sequentially outputting pulses to S1–S11. Specifically, if the value counted up in the step F11 is within a range of 2–127 in the step F12. the control process goes back to the step F6, thereby repeating the control to sequentially output pulses to the signal terminals S1–S11. If the counted-up value is equal to 128, the preliminary discharge process is completed.

Figure 6:
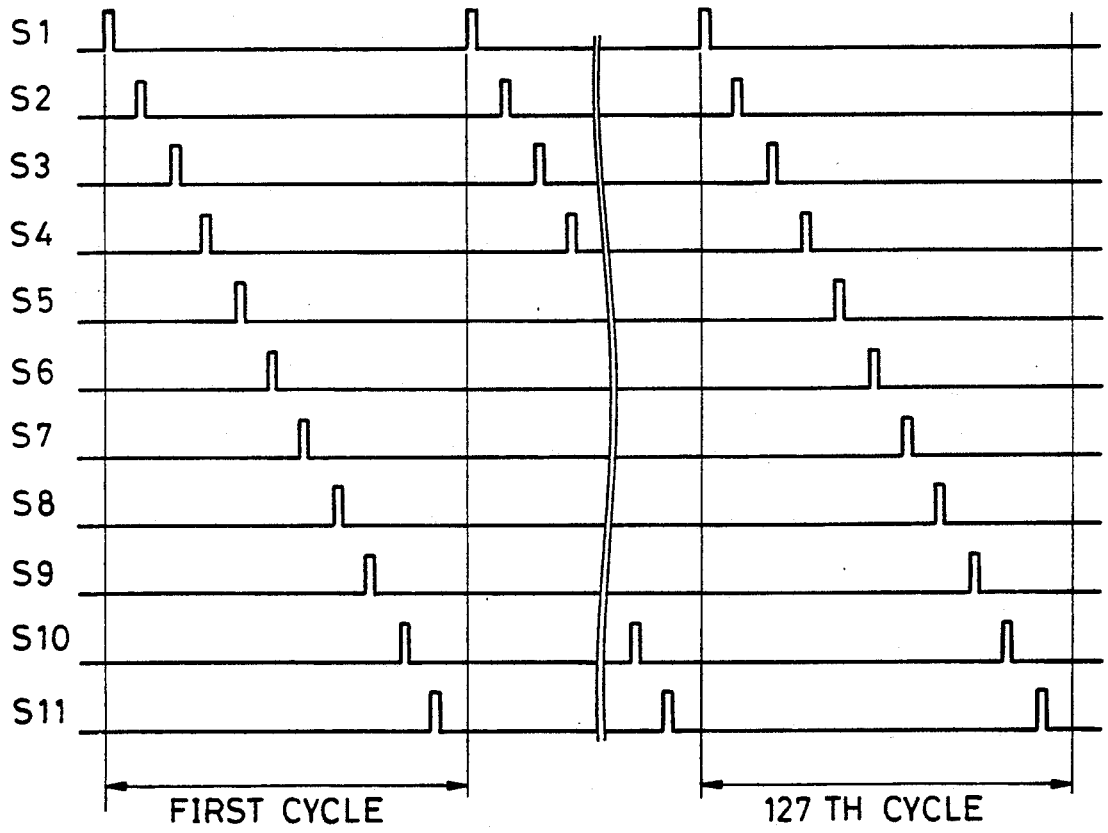
FIG. 6 is a timing chart of the processing represented by the flowchart shown in FIG. 3.

FIG. 6 is a timing chart showing the output waveforms from the signal terminals S1–S11 when the preliminary discharge is carried out through the processing steps as described above. In FIG. 6, delivery of the signals S1–S11 corresponding to 1 cycle of the preliminary discharge is executed by repeating the steps F6–F9 shown in FIG. 5. Repetition from the 1-st cycle to the 127-th cycle is executed based on the determination made in the step F12 shown in FIG. 5.

Figure 7:
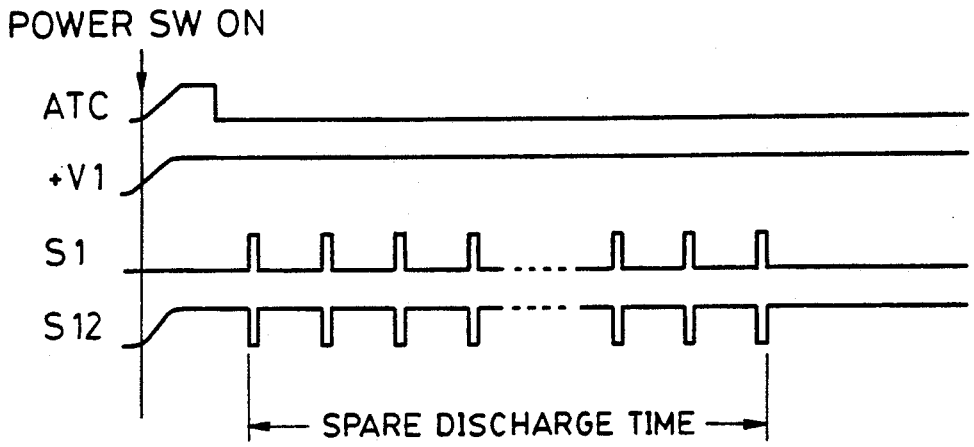
FIG. 7 is a timing chart of respective signals used in the principal configuration shown in FIG. 1.

FIG. 7 depicts the output waveform from the output terminal S1 dedicated to preliminary discharge, and the waveform signal S12 applied to the heaters H1 and H12.

In FIG. 7, when the signal D1 is delivered during the preliminary discharge period as represented by FIG. 5, the signal S1 is converted to a signal S12 after current amplification by the Darlington circuit comprising the resistors R1, R2 and the transistors TR1, TR2. As a result, a current flows through the heaters H1 and H12 due to the potential difference between the voltage +V1 connected to one end and the signal S12 connected to the other end, so that the heaters H1 and H12 produce heat for preliminarily discharging ink from the 1-st and 12-th ink discharge openings.

Figure 8:
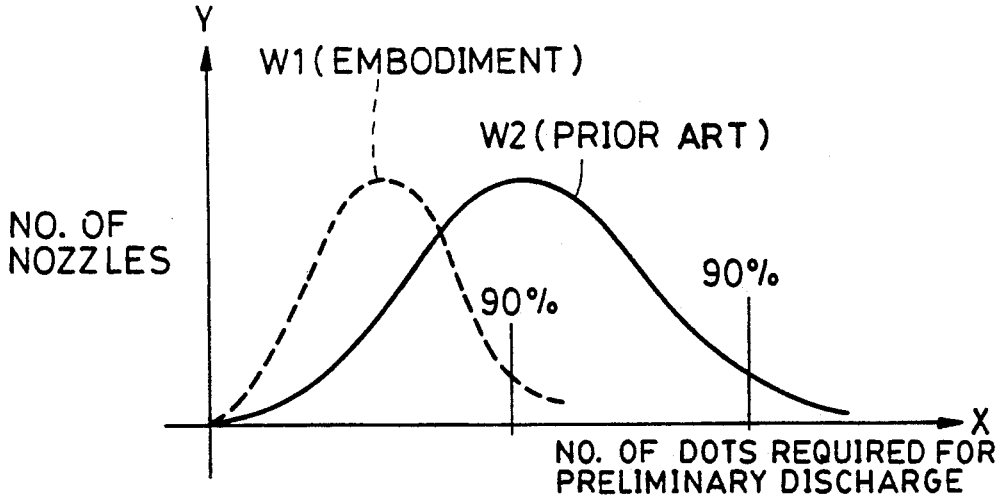
FIG. 8 is a histogram for explaining the effect obtainable by implementing the present invention.

FIG. 8 is a graph showing comparison between the case in which the preliminary discharge is implemented by the processing shown in FIG. 5 according to the foregoing embodiment and the case in which no discharge unit dedicated to preliminary discharge is provided as with the prior art. In FIG. 8, the X-axis represents the number of discharge dots necessary for reaching a good discharge condition through the delivery discharge, and the Y-axis represents the number of discharge unit that can provide good characters or graphics with the number of dots necessary for the preliminary discharge indicated by the X-axis.

In FIG. 8, W1 designates the number distribution of discharge units as obtained with the case in which the preliminary discharge is carried out by providing the discharge units dedicated to preliminary discharge according to this embodiment, and W2 designates the number distribution of discharge units as obtained with the prior art. As will be apparent from the figure, according to this embodiment, the substantially equal number of heads can provide good characters or graphics with the number of prelinimnary discharge dots substantially equal to half of that needed in the prior art. The experiment has proved that implementing the preliminary discharge of the present invention with the total dot number of 2192 can present the comparable result of the prior art with the total dot number of 5120.

Figure 9:
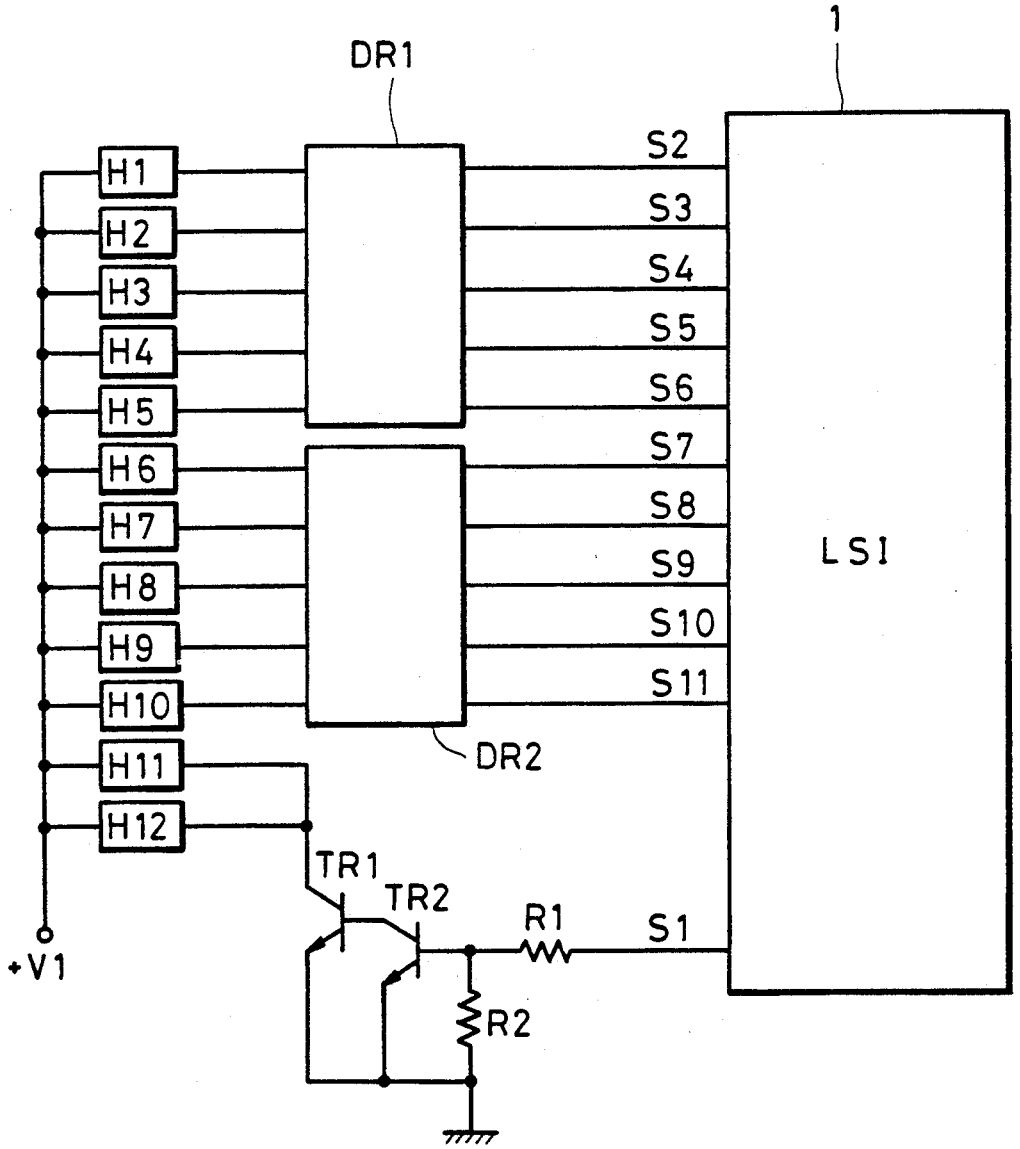
FIG. 9 is a block diagram for explaining the principal configuration according to another preferred embodiment of the present invention.

FIG. 9 is a block diagram showing the configuration according to another preferred embodiment of the present invention. In FIG. 9, the heaters dedicated to preliminary discharge are given by H11 and H12 among the heaters H1–H12. This embodiment is suitable for a head of the type that the viscosity of ink is increased near the lowermost one in the array of ink discharge openings.

As with the above first embodiment, when a preliminary discharge signal S1 is output from the LSI1, this signal is amplified by a Darlington circuit, causing a current to pass through the heaters H11 and H12. The preliminary discharge carried out with the signal S1 and the recording signals S2–S11 is effective particularly in reducing the viscosity of ink near the lowermost one in the array of ink discharge openings.

According to the present invnetion, as will be apparent from the foregoing discription, the number of total dots necessary for recovery of the normal discharge can be reduced, for example, by making at least the discharge unit disposed at one end of the array of discharge openings exclusively specific to preliminary discharge, and carrying out the preliminary discharge together with the specific discharge unit.

Consequently, the period for preliminary discharge is shortened to enable rapid recording in response to key operations in a printer, for example.

There can be obtained such other advantageous effects that the amount of ink waste for the preliminary discharge is reduced, and a risk of leaking ink from an ink absorber as the ink collector is diminished.

It will be understood that while the present invention has been described in connection with the embodiment using a so-called disposable type ink jet cartridge which comprises an ink tank and an ink jet head in one-piece having a relatively small capacity, it is also applicable to an apparatus with only a replaceable ink tank.

Further, application of the present invention to the disposable type ink jet cartridge is more effective because the ink capacity is relatively small in many cases.

Moreover, it is not essential for the above-mentioned preliminary discharge circuit to be formed of a Darlington circuit as illustrated. The present invention may be modified such that one or more electro-thermal transducers in the discharge units dedicated to preliminary discharge are connected to the head drivers as with those in the remaining discharge units, and the control circuit is designed to apply drive signals to the electro-thermal transducers in the discharge units dedicated to preliminary discharge only during the preliminary discharge.

Alternatively, for the effective discharge stabilizing process, the opening area of the discharge opening dedicated to preliminary discharge and the cross-sectional area of the liquid passage in communication with that discharge opening may be set larger than the opening area of other discharge openings and the cross-sectional area of other liquid passages which are used for recording, respectively.

Besides, it is also effective in furhter stabilizing the diacharge process to increase the dimension of the discharge energy generator (e.g., the heat generating area for an electro-thermal transduer) because this assists in insuring discharge from the discharge unit dedicated to preliminary discharge.

In addition, it will be understood that the present invention is not limited to the foregoing embodiments and can be modified without departing from the spirit and scope of the invention.

What is claimed is:

1. A method of driving an ink jet recording head comprising the steps of:

providing a plurality of discharge units each having a discharge opening for discharging a liquid therethrough and a discharge energy generator associated with said discharge opening for generating energy for discharging the liquid from said discharge opening;

performing a discharge stabilization process by discharging liquid from said plurality of discharge units; and performing a recording process by discharging liquid from at least one of said discharge units, wherein the number of discharge units utilized during said discharge stabilization process is greater than the number of discharge units which discharge liquid during said recording process and a predetermined number of said discharge units are dedicated to use only during said discharge stabilization process, to provide a stable discharge condition of said ink jet recording head.

2. A method of driving an ink jet recording head according to claim 1, wherein said dicharge energy generators produce thermal energy.

3. A method of driving an ink jet recording head according to claim 2, wherein the thermal energy generates bubbles in the liquid and the bubbles discharge the liquid from said discharge openings.

4. A method of driving an ink jet recording head according to claim 1, wherein said plurality of discharge units form an array and at least one said discharge unit located at an extreme end of said array performs said discharging step.

5. A method of driving an ink jet recording head according to claim 1, wherein liquid is discharged from a plurality of said discharge units during said discharging step.

6. A method of driving an ink jet recording head according to claim 5, wherein said discharge units form an array and said plurality of discharge units are located on at least opposite ends of said array.

7. A method of driving an ink jet recording head according to claim 1, wherein liquid is discharged from all of said discharge units said discharging stabilization process.

8. An ink jet recording apparatus operable in a preliminary discharge operation and a recording operation, said recording apparatus comprising:

an ink jet recording head having a plurality of discharge units each having a discharge opening for discharging a liquid therethrough and a discharge energy generator associated with said discharge opening for generating energy for discharging the liquid from said discharge opening in response to a recording drive signal during the recording operation and a preliminary discharge signal during the preliminary discharge operation, a predetermined number of said discharge units being dedicated to use only during the preliminary discharge operation; and a discharge control circuit for controlling the discharge of liquid through said discharge openings, said control circuit generating and applying said recording drive signal and said preliminary discharge signal, wherein said discharge control circuit applies said preliminary discharge signal in the preliminary discharge operation to more of said discharge energy generators than the number to which said control circuit applies said recording drive signal in the recording operation, in order to discharge liquid from said discharge openings associated with such discharge energy generators and thereby to provide a stable discharge condition of said ink jet recording head.

9. An ink jet recording apparatus according to claim 8, wherein each of said discharge energy generators is an electro-thermal transducer.

10. An ink jet recording apparatus according to claim 9, wherein said electro-thermal transducer generates bubbles in the liquid by heating and the bubbles discharge the liquid from said discharge openings.

11. An ink jet recording apparatus according to claim 8, wherein said plurality of discharge units form an array and at least one said discharge energy generator is used for discharging liquid prior to recording and is associated with the discharge unit located at an end of said array.

12. An ink jet recording apparatus comprising:

a driver for generating drive signals;

an ink jet recording head having a plurality of discharge units each having a discharge opening for discharging a liquid therethrough and a discharge energy generator associated with said discharge openings for generating energy for discharging the liquid from said discharge opening in response to said drive signal or a preliminary discharge signal; and a preliminary discharge circuit for generating said preliminary discharge signal, wherein said preliminary discharge signal is applied to less than all of said discharge energy generators for discharging liquid from said discharge openings associated with such discharge energy generators prior to recording, said preliminary discharge circuit including wiring electrically connected only to discharge energy generators used for discharging liquid prior to recording.

13. An ink jet recording apparatus according to claim 11, wherein said preliminary discharge circuit is a Darlington circuit.

14. An ink jet recording apparatus according to claim 12, wherein said preliminary discharge circuit is included in a control circuit of said ink jet recording apparatus.

15. An ink jet recording apparatus according to claim 13, wherein said driver produces said drive signals in response to signals from said control circuit.

16. An ink jet recording head operable in a preliminary discharge operation and a recording operation, said ink jet recording head comprising:

a first discharge unit having a first discharge opening for discharging a liquid therethrough and a first discharge energy generator associated with said first discharge opening for generating energy to discharge liquid from said first discharge opening in both a recording operation and a preliminary discharge operation prior to the recording operation in order to provide stable discharge during the recording operation;

a second discharge unit dedicated to preliminary discharge and having a second discharge opening for discharging a liquid therethrough and a second discharge energy generator associated with said second discharge opening for generating energy to discharge liquid from said second discharge opening only in the preliminary discharge operation; and means for performing the recording operation and the preliminary discharge operation.

17. An ink jet recording head according to claim 16, wherein one of said second discharge units is disposed on opposite sides of said first discharge unit.

18. An ink jet recording head according to claim 17, wherein a plurality of said first discharge units is provided.

19. An ink jet recording head according to claim 16, wherein said second discharge unit is disposed only on one side of said first discharge unit.

20. An ink jet recording head according to claim 16, wherein the area of said discharge opening of said second discharge unit is larger than the area of said discharge opening of said first discharge unit.

21. An ink jet recording head according to claim 16, wherein said discharge energy generators are electro-thermal transducers.

22. An ink jet recording head according to claim 21, wherein said electro-thermal transducer generates bubbles in the liquid by heating and the bubbles discharge the liquid from said discharge openings.

23. An ink jet recording apparatus including an ink jet recording head, said apparatus comprising:

a plurality of discharge openings in said ink jet recording head for discharging a liquid therethrough and a plurality of discharge energy generators associated with said discharge opening for generating energy for discharging the liquid from said discharge openings, said discharge energy generators being divided into first second groups the second group including the discharge energy generators of the first group and including a number of energy generators greater in number than in the first group, a predetermined number of said second group of discharge energy generators being dedicated to use only during a preliminary discharge operation;

a recording signal generating means for generating recording signals that are applied to the first group of said plurality of discharge energy generators for discharging liquid for recording from said discharge openings corresponding to the first group of discharge energy generators; and preliminary discharging signal generating means for generating preliminary discharge signals during the preliminary discharge operation that are applied to the second group of discharge energy generators, said preliminary discharge signals for discharging liquid from discharge openings corresponding to the second group of discharge energy generators to provide a stable discharge. condition.

24. An ink jet recording apparatus according to claim 23, wherein said second group of discharge energy generators includes all of said discharge energy generators of said ink jet recording head.

25. An ink jet recording apparatus according to claim 23, wherein said discharge energy generators produce thermal energy.

26. An ink jet recording apparatus according to claim 25, wherein the thermal energy generates bubbles in the liquid and the bubbles discharge the liquid from said discharge openings.

27. An ink jet recording apparatus according to claim 23, further comprising key inputting means for inputting keyed information, wherein a recording operation is performed in response to the keyed information inputted by said key inputting means.

28. An ink jet recording apparatus according to claim 27, wherein said apparatus is incorporated in an electronic calculator.

29. An ink jet recording apparatus according to claim 27, wherein said apparatus is incorporated in a typewriter.

30. An ink jet recording apparatus according to claim 23, further comprising data storing means for storing data from which said recording signal generating means generates said recording signals.

31. An ink jet recording apparatus including an ink jet recording head in which a first group and a second group of discharge openings for discharging liquid are arranged in a predetermined direction, said second group of discharge openings being dedicated to use only during a preliminary discharge operation, said recording head movable in a scanning direction, said apparatus comprising:

a first discharge signal generating means for generating a first discharge signal during a recording operation and the preliminary discharge operation, said first signal being applied to discharge energy generators corresponding to said first group of discharge openings of said arranged discharge openings, to discharge liquid from the first group of discharge openings; and a second discharge signal generating means for generating a second discharge signal only during the preliminary discharge operation, said second signal being applied to discharge energy generators corresponding to said second group of discharge openings to discharge liquid from the second group of discharge openings.

32. An ink jet recording apparatus according to claim 31, wherein said discharge energy generators produce thermal energy.

33. An ink jet recording apparatus according to claim 32, wherein the thermal energy generates bubbles in the liquid and the bubbles discharge the liquid from said discharge openings.

34. An ink jet recording apparatus according to claim 31, further comprising key inputting means for inputting keyed information, wherein the recording operation is performed in response to the keyed information inputted by said key inputting means.

35. An ink jet recording apparatus according to claim 31, wherein said apparatus is incorporated in an electronic calculator.

36. An ink jet recording apparatus according to claim 31, wherein said apparatus is incorporated in a typewriter.

* * * * *